US005507591A

United States Patent [19]

Lyons et al.

[11] Patent Number: 5,507,591

[45] Date of Patent: Apr. 16, 1996

[54] POWER CROWN ON ASPHALT SCREED

[75] Inventors: Scott F. Lyons, Shippensburg; David L. Lindecamp, Greencastle; Leonard E. Speers, Fayetteville, all of Pa.

[73] Assignee: Ingersoll-Rand Company, Woodcliff Lake, N.J.

[21] Appl. No.: 376,587

[22] Filed: Jan. 20, 1995

[51] Int. Cl.[6] ..... E01C 19/22

[52] U.S. Cl. ..... 404/96; 404/118

[58] Field of Search ..... 404/96, 118, 119, 404/120

[56] References Cited

U.S. PATENT DOCUMENTS

| | | | |
|---|---|---|---|
| 2,890,632 | 6/1959 | Madison et al. | 404/96 |
| 3,557,672 | 1/1971 | Shurtz et al. | 404/118 X |
| 3,559,544 | 2/1971 | Miller | 404/96 |
| 4,688,965 | 8/1987 | Smith et al. . | |
| 4,702,642 | 10/1987 | Musil | 404/118 |

OTHER PUBLICATIONS

Blaw–Knox Brochure, Paver/Finisher PF–172B, p. 1.

*Primary Examiner*—Ramon S. Britts
*Assistant Examiner*—James A. Lisehora
*Attorney, Agent, or Firm*—John J. Selko

[57] ABSTRACT

A power crown adjustment apparatus for an asphalt screed includes first and second screed subassemblies movable with respect to each other, power apparatus for moving the subassemblies with respect to each other to alter the crown and control apparatus for automatically preventing the first and second screed subassemblies from moving beyond the predetermined range of movement.

3 Claims, 4 Drawing Sheets

POWER CROWN ON ASPHALT SCREED

BACKGROUND OF THE INVENTION

This invention relates generally to screeds on mobile paving machines, and more particularly to powered devices for altering the crown of material being smoothed by the screed.

In prior art powered crown devices, there is a need to provide a fail safe or automatic shut-off mechanism for a manual hydraulic control valve that is used to control a hydraulically driven, power screw, or turnbuckle style, crowning device for an asphalt screed. If the distance of the movement of the power screw extension is not limited in some way, the danger of turning the screw out of the external body (male portion) exists which would result in the center of the screed falling to the ground.

One attempt to solve this problem involved providing a hole near the end of the screws to accept a roll pin which would extend to the major thread diameter of the screw. The limitation here is that the turnbuckle could now be seized with damage to the external turnbuckle body threads caused by forcing the roll pin into those threads. This solution resulted in damaged parts which would most likely have to be replaced.

Another attempt to solve this problem involved providing stops on the screed frame which would limit the crowning motion. The limitation here is that the screed would have to be beefed up to withstand the maximum thrust of the power screw. This system results in added stresses in the screed frame.

The foregoing illustrates limitations known to exist in present power crown devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a power crown adjustment apparatus for a screed comprising: a flexible bottom plate for contacting a surface to be smoothed, the bottom plate extending across a longitudinal centerline of the material; a first screed subassembly attached to the bottom plate and positioned above the bottom plate on a first side of the longitudinal centerline; a second screed subassembly attached to the bottom plate, positioned above the bottom plate on a second side of the longitudinal centerline and spaced from the first screed subassembly; actuator means for adjusting the crown of material under the bottom plate by moving the first and second screed subassemblies with respect to each other within a predetermined range of movement, thereby bending the bottom plate in relation to the longitudinal centerline; and control means for automatically controlling the actuator means to prevent the first and second screed subassemblies from moving beyond the predetermined range of movement.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
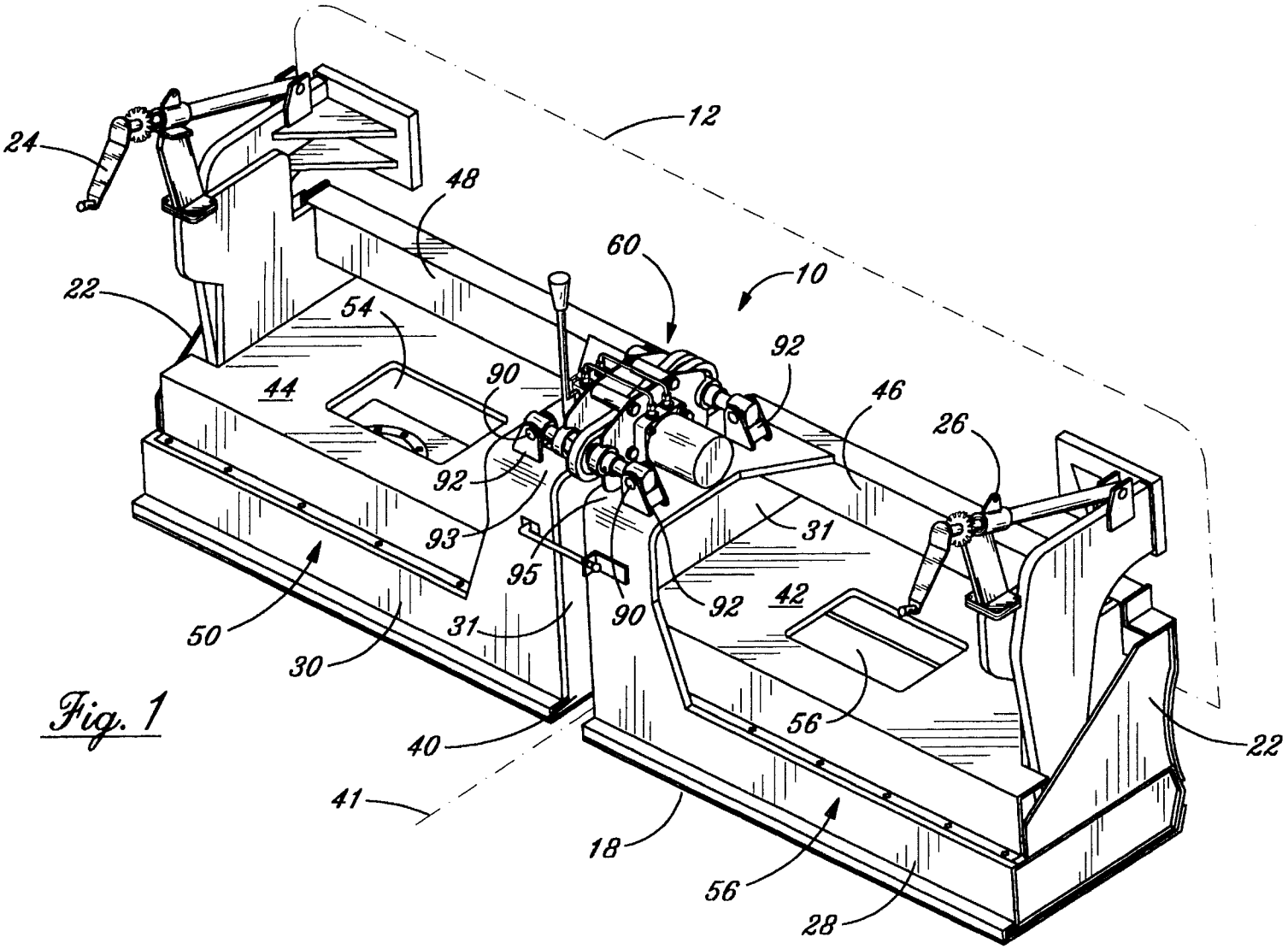
FIG. 1 is a perspective schematic view of the screed of the invention, with parts removed.

Referring to FIG. 1, the screed of the invention is shown generally as 10. Screed 10 is attached to the rear of a paving tractor 12 of conventional design, shown in phantom. The means of attachment are well known. Screed 10 floats behind paver 12 and smooths the material deposited by the paver 12 as it advances. Screed 10 includes a flat, transversely extending flexible bottom plate 18 that extends from a pair of outer side plates 22 and is spaced above a roadbed being paved. A pair of adjustment devices 24, 26 are provided to selectively vary the pitch angle of screed plate 18. A pair of rear support members 28, 30 are secured to the upper edge of plate 18 with their inner edges connected to a pair of spaced apart inner side plates 31 so as to define a gap 40. The longitudinal centerline axis 41 of the machine 12 extends through gap 40. A pair of top plates 42, 44 extend from the rear plates forwardly to a pair of spaced front members 46, 48 which are secured at their lower ends to plate 18 and extend upwardly for attachment at their outer edges to side plates 22, and at their inner edges to side plates 31. Thus, it should be understood that there is provided a first screed subassembly 50 attached to bottom plate 18 and positioned above plate 18 at one side of axis 41. There is also provided a second screed subassembly 52 attached to bottom plate 18 and positioned above plate 18 at an opposite side of centerline axis 41. Screed subassemblies 50, 52 are essentially separate units, except for their connection to plate 18. Each screed subassembly 50, 52 includes a hollow heating chamber 54, 56, as is well known.

The crown of material being deposited is determined by the lateral profile of plate 18. This profile is adjusted by power actuator means 60, which moves first and second screed subassemblies 50, 52 with respect to each other, thereby bending plate 18 in relation to centerline axis 41. The crown of material being smoothed coincides with axis 41.

Figure 2:
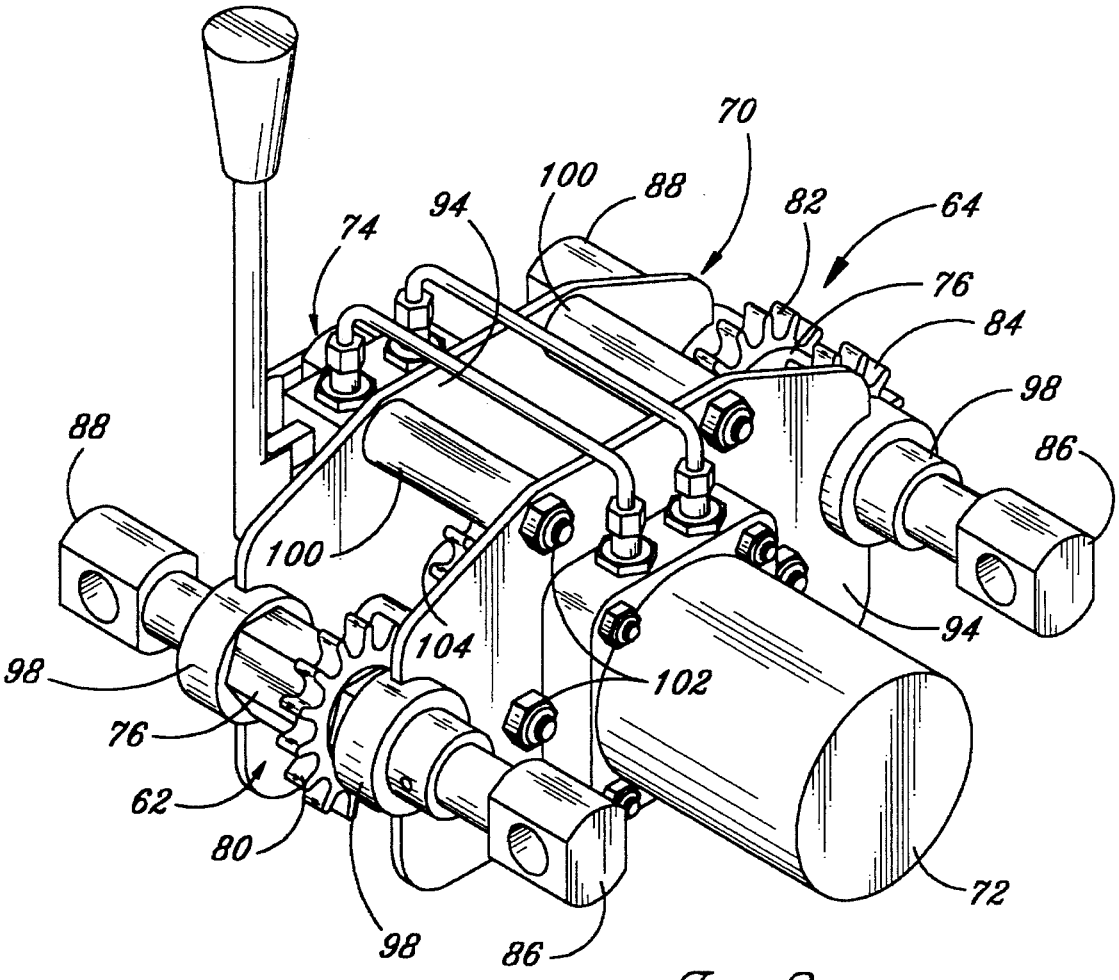
FIG. 2 is a perspective view of a power crown actuator device of the invention, with parts removed.
Figure 3:
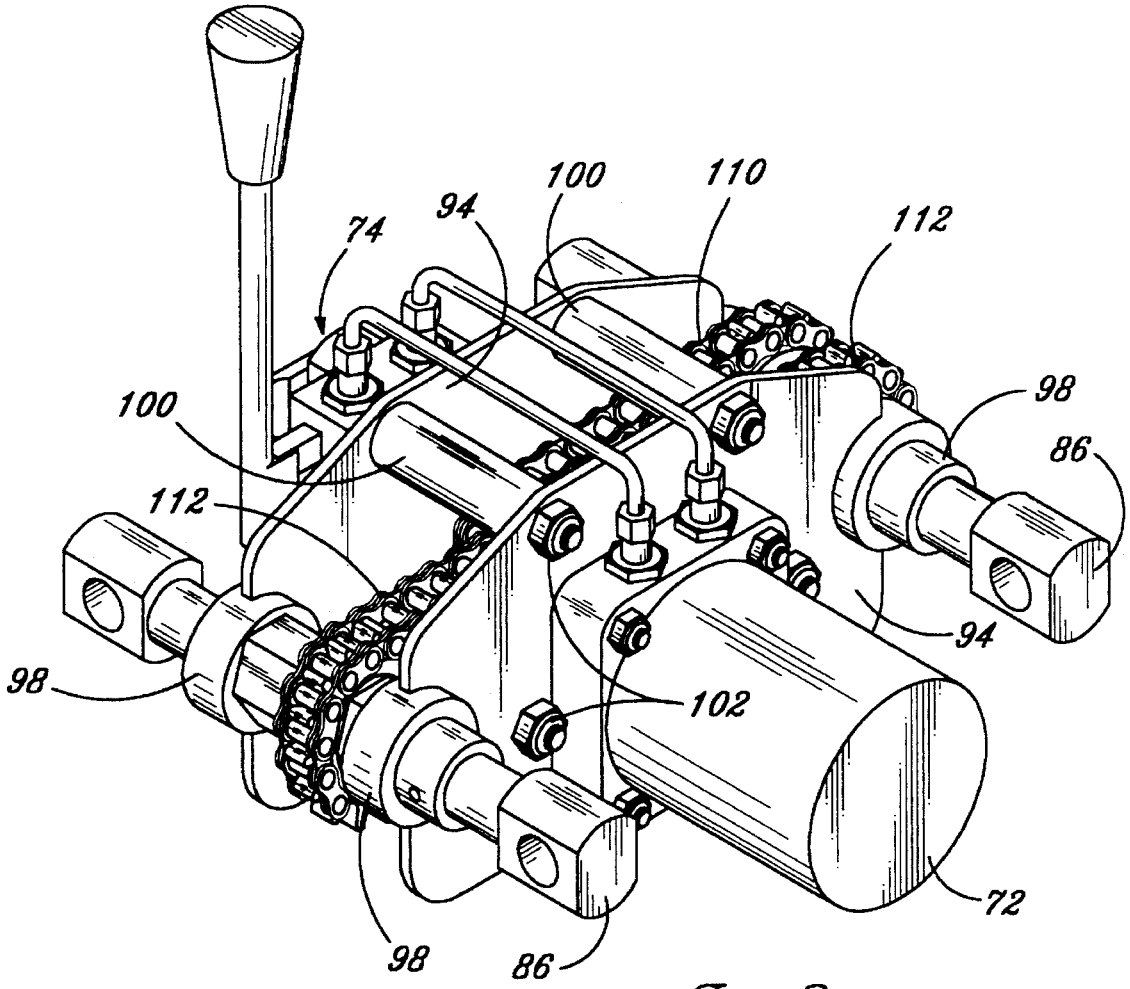
FIG. 3 is a view similar to FIG. 2.

As shown in FIGS. 2 and 3, actuator means 60 comprises two turnbuckles 62, 64 which are spanned by a mounting member 70 which, in turn, supports a conventional hydraulic drive motor 72 and a conventional hydraulic control valve assembly 74 for motor 72. Turnbuckle 62 includes turnbuckle body 76 with sprocket 80 affixed thereto. Turnbuckle 64 includes turnbuckle body 76 with sprockets 82, 84 affixed thereto. One end of turnbuckle body 76 has right hand threads, while the other end has left hand threads. The right hand threaded turnbuckle rod 86 is turned into the appropriate end of turnbuckle body 76 and the left hand threaded turnbuckle rod 88 is turned into the other end of turnbuckle body 76. Rods 86, 88 are connected to screed 10 at pivot pins 90 and clevises 92 attached to transverse plates 93 on screed portions 50, 52 (FIG. 1).

Mounting member 70 includes two spaced apart side plates 94. Side plates 94 have collars 98 affixed thereto to accept the turnbuckles 62, 64. Thus, turnbuckles 62, 64 are rotatably mounted into mounting member 70. Side plates 94 are connected together through tubes 100, and fasteners 102. Motor 72 is mounted through one side of the mounting member 70, while the manual control valve assembly 74 is mounted on the other side. A sprocket 104 is mounted on the hydraulic motor 72 longitudinally in line with sprocket 82 of turnbuckle 64. Motor 72 drives turnbuckle 64 via a short chain 110 that extends around sprockets 82, 104 (FIG. 3). The second turnbuckle 64 is connected to the first turnbuckle 62 by a long chain 112 that extends around sprockets 80 and 84, which sprockets are longitudinally aligned with each other. Motor 72 is a reversibly actuated by a manually operated throttle lever actuator means 74.

Figure 4:
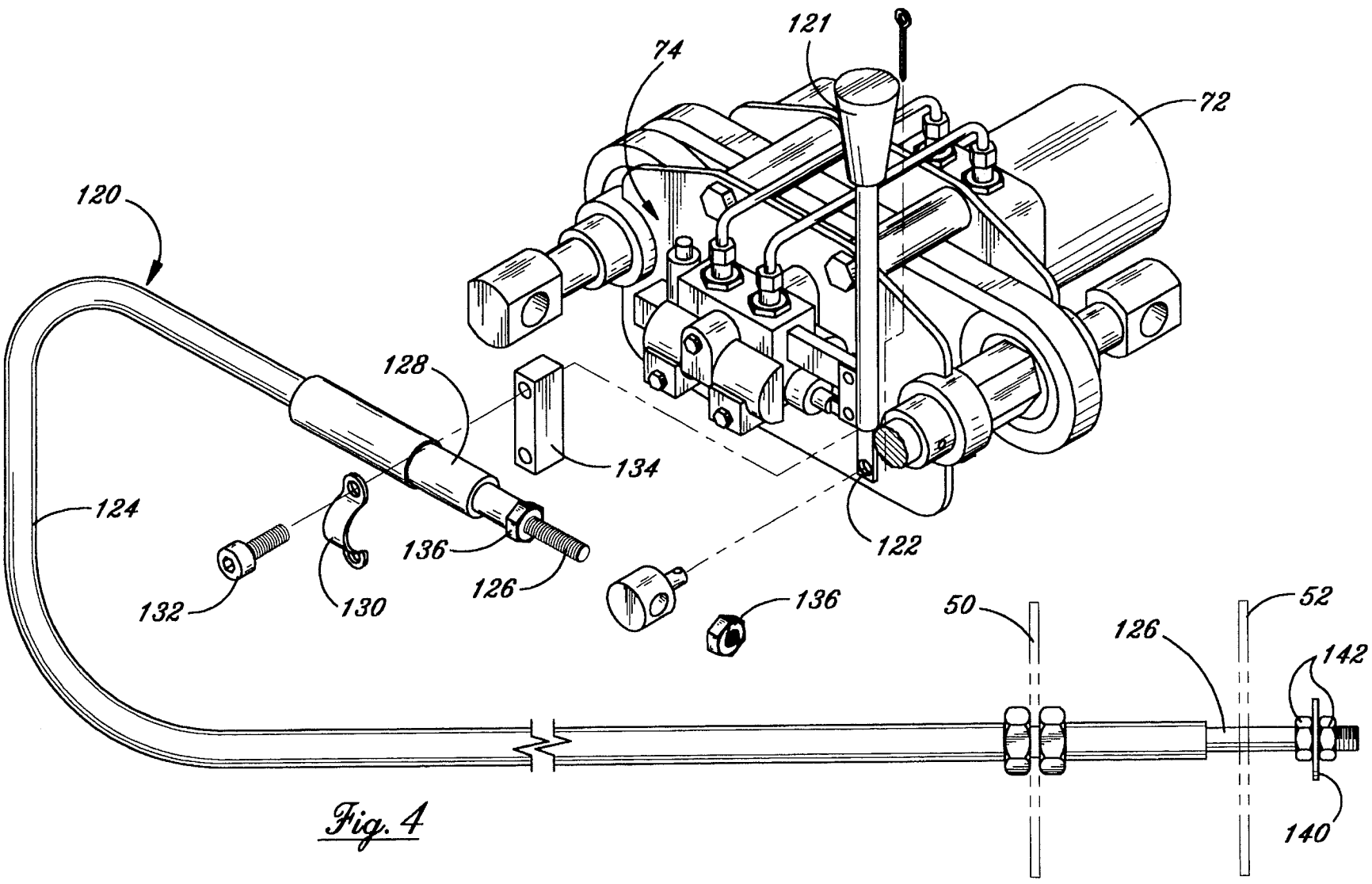
FIG. 4 is a schematic, perspective and partly exploded view of a cable control assembly of the invention.

A cable assembly control means for automatically controlling the actuator means 74, to prevent the first and second screed subassemblies 50, 52 from moving beyond a predetermined range of movement will now be described. As shown in FIG. 4, a cable assembly 120 connects lever 121 and lever extension 122 (of lever actuator means 74) to mounting member 70. The cable assembly 120 is a standard push-pull cable 124 having a flexible, but stiff, wire center member 126 slidably carried within an outer sheath 128. At a first end of cable 124, outer sheath 128 is connected to the side of mounting member 70 with a clamp 130, fasteners 132, and a shim block 134. Center wire 126 is connected to lever extension member 122 by jam nuts 136.

The second end of cable 124 has sheath 128 anchored to first screed subassembly 50, with the center wire 126 and sheath 128 extending to the second screed subassembly 52. At the end of the center wire 126, a washer 140 is supported by a second set of jam nuts 142. In operation, as the first and second screed subassemblies 50, 52 are pushed apart, screed subassembly 52 encounters washer 140. As the subassemblies 50, 52 continue to move apart, subassembly 52 gradually pulls center wire 126 which, in turn, pulls on lever 121. As the screed 10 crowns even further, lever 121 is pulled back to neutral even if the operator is still applying pressure to the lever 121. The jam nuts 136, 142 on either end of cable 124 can be fine tuned to limit the extension of the threaded turnbuckle rods 86, 88 to prevent their being turned out too far.

Having described the invention, what is claimed is:

1. A power crown adjustment apparatus for a screed comprising:

a. a flexible bottom plate for contacting a surface of material to be smoothed, the bottom plate extending across a longitudinal centerline of the material;

b. a first screed subassembly attached to the bottom plate and positioned above the bottom plate on a first side of the longitudinal centerline;

c. a second screed subassembly attached to the bottom plate, positioned above the bottom plate on a second side of the longitudinal centerline and spaced from the first screed subassembly;

d. actuator means for adjusting the crown of material under the bottom plate by moving the first and second screed subassemblies with respect to each other within a predetermined range of movement, thereby bending the bottom plate in relation to the longitudinal centerline;

e. control means for automatically controlling the actuator means to prevent the first and second screed subassemblies from moving beyond the predetermined range of movement;

f. the actuator means comprising:

(i) a first turnbuckle assembly reversibly connecting the first and second screed subassemblies at a first segment thereof;

(ii) a second turnbuckle assembly reversibly connecting the first and second screed subassemblies at a second segment thereof; and (iii) hydraulic motor means for reversibly turning the first and second turnbuckle assemblies to move the first and second screed subassemblies within the predetermined range; and (g) comprising:

(i) throttle lever actuator means, including a throttle lever, for reversibly activating the hydraulic motor; and (ii) control cable means having a first end connected to said throttle lever and a second end connected to the first and second screed subassemblies, the control cable means having a predetermined length to permit movement of the screed subassemblies connected thereto within the predetermined range and to gradually move the throttle lever to a neutral position as the screed subassemblies approaches an outer limit of the range of movement.

2. The Apparatus of claim 1 wherein the control cable means includes a push-pull cable.

3. A power crown adjustment apparatus for a screed comprising:

a. a flexible bottom plate for contacting a surface of material to be smoothed, the bottom plate extending across a longitudinal centerline of the material;

b. a first screed subassembly attached to the bottom plate and positioned above the bottom plate on a first side of the longitudinal centerline;

c. a second screed subassembly attached to the bottom plate, positioned above the bottom plate on a second side of the longitudinal centerline and spaced from the first screed subassembly;

d. a first turnbuckle assembly reversibly connecting the first and second screed subassemblies at a first segment thereof;

e. a second turnbuckle assembly reversibly connecting the first and second screed subassemblies at a second segment thereof;

f. said first and second turnbuckle assemblies being interconnected to each other;

g. hydraulic motor means for reversibly turning the first and second turnbuckle assemblies simultaneously, to move the first and second screed subassemblies within the predetermined range; and h. control means for automatically preventing the first and second screed subassemblies from moving beyond the predetermined range of movement.

* * * * *